US008023671B2

(12) United States Patent
Hou

(10) Patent No.: US 8,023,671 B2
(45) Date of Patent: Sep. 20, 2011

(54) PIEZOELECTRIC BUZZER DRIVING CIRCUIT

(75) Inventor: Zhen Hou, Foshan (CN)

(73) Assignees: Premier Image Technology(China) Ltd., Foshan, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 1000 days.

(21) Appl. No.: 11/923,027

(22) Filed: Oct. 24, 2007

(65) Prior Publication Data

US 2008/0247574 A1 Oct. 9, 2008

(30) Foreign Application Priority Data

Apr. 6, 2007 (CN) ..... 2007 1 0200410

(51) Int. Cl.
*H04R 25/00* (2006.01)

(52) U.S. Cl. ..... 381/190; 381/111; 381/116; 381/120; 381/123; 330/199; 330/297

(58) Field of Classification Search ..... 381/190–191, 381/111, 116, 123, 120; 330/199, 297
See application file for complete search history.

(56) References Cited

U.S. PATENT DOCUMENTS 6,411,138 B2 * 6/2002 Yamakita et al. ..... 327/109
2001/0020856 A1 9/2001 Yamakita et al.

FOREIGN PATENT DOCUMENTS

CN 1390079 A 1/2003
JP 8123425 A 5/1996

* cited by examiner

*Primary Examiner* — Richard A. Booth
(74) *Attorney, Agent, or Firm* — Altis Law Group, Inc.

(57) ABSTRACT

A piezoelectric buzzer driving circuit (200) for driving a piezoelectric buzzer (211) with two terminals includes a reverser (216). The reverser includes an output terminal and an input terminal (24) configured for receiving a controlling signal to control an output of the reverser. The two terminals of the piezoelectric buzzer respectively connected to the input terminal and the output terminal such that a D-value of the voltage across the piezoelectric buzzer is twice as large as the voltage of the controlling signal.

10 Claims, 5 Drawing Sheets

PIEZOELECTRIC BUZZER DRIVING CIRCUIT

BACKGROUND

1. Field of the Invention

The present invention relates to sound control units, particularly to piezoelectric buzzer driving circuits.

2. Description of Related Art

General consumer electronic products, such as personal computers, automobiles, communication terminals etc. can produce sounds, such as warning or ringing sounds. This is done by using internal sound producers, such as buzzers.

One type of buzzer is a piezoelectric buzzer. Referring to FIG. 5, a typical piezoelectric buzzer driving circuit is shown. The piezoelectric buzzer driving circuit includes a driving circuit 10 for driving a piezoelectric buzzer 111. The driving circuit 10 includes a transistor Q10, and two resistors R1 and R2.

The base of the transistor Q10 is connected to a controlling terminal 12, which provides a controlling signal to the piezoelectric buzzer 111 via the resistor R2. The collector of the transistor Q10 is connected to a power supply terminal 11 via the resistor R1. The emitter of the transistor Q10 is grounded.

Two terminals of the resistor R1 are set respectively as a first output terminal 14 and a second output terminal 16 of the driving circuit 10. The piezoelectric buzzer 111 is connected to the first output terminal 14 and the second output terminal 16.

The power supply terminal 11 provides a direct-current power supply with a voltage U11. The controlling signal provided from the controlling terminal 12 is a periodic impulse signal with a constant frequency for controlling the input voltage at the power supply 11. The transistor Q10 may be turned on or off according to the controlling signal.

A voltage across the piezoelectric buzzer 111 is ΔU1, a voltage at the first output terminal 14 is U14, and a voltage at the second output terminal 16 is U16. Therefore, ΔU1 is expressed as: ΔU1=U14−U16.

When the transistor Q10 is turned on, the voltage U14 of the first output terminal 14 is approximately equal to the voltage U11, and the voltage U16 of the second output terminal 16 is approximately equal to zero. Therefore, the voltageΔU1=U14−U16=U11.

When the transistor is turned off, the voltage U14 of the first output terminal 14 and the voltage U16 of the second output terminal 16 are both approximately equal to the voltage U11. Therefore, the voltageΔU1=U14−U16=0.

With the above description, during each on-off period of the transistor Q10, a varied voltage ΔU12 across the piezoelectric buzzer 111 is expressed as ΔU12=U110=U11. That is to say, maximum varied voltage ΔU12 across the piezoelectric buzzer 111 during each on-off period of the transistor Q10 is approximately equal to the voltage U11. On the other hand, a sound efficiency (i.e., electrical energy input against sound energy output) of the piezoelectric buzzer 111 is dependent on the voltage from the power supply terminal 11. The higher the voltage from the power supply terminal 11 is, the better the sound efficiency of the piezoelectric buzzer 111 is. However, high voltage electricity may cause damage in some consumer electronic products.

What is needed, therefore, is to provide a piezoelectric buzzer driving circuit with satisfactory sound efficiency even under low voltage.

SUMMARY

In a present embodiment, a piezoelectric buzzer driving circuit for driving a piezoelectric buzzer with two terminals includes a reverser. The reverser includes an output terminal and an input terminal configured for receiving a controlling signal to control an output of the reverser. The two terminals of the piezoelectric buzzer respectively connected to the input terminal and the output terminal such that a D-value of the voltage across the piezoelectric buzzer is twice as large as the voltage of the controlling signal.

Advantages and novel features will become more apparent from the following detailed description of the present piezoelectric buzzer driving circuit, when taken in conjunction with the accompanying drawings.

BRIEF DESCRIPTION OF THE DRAWINGS

Many aspects of the present piezoelectric buzzer driving circuit can be better understood with reference to the following drawings. The components in the drawings are not necessarily drawn to scale, the emphasis instead being placed upon clearly illustrating the principles of the present piezoelectric buzzer driving circuit. Moreover, in the drawings, like reference numerals designate corresponding parts throughout the several views.

Figure 1:
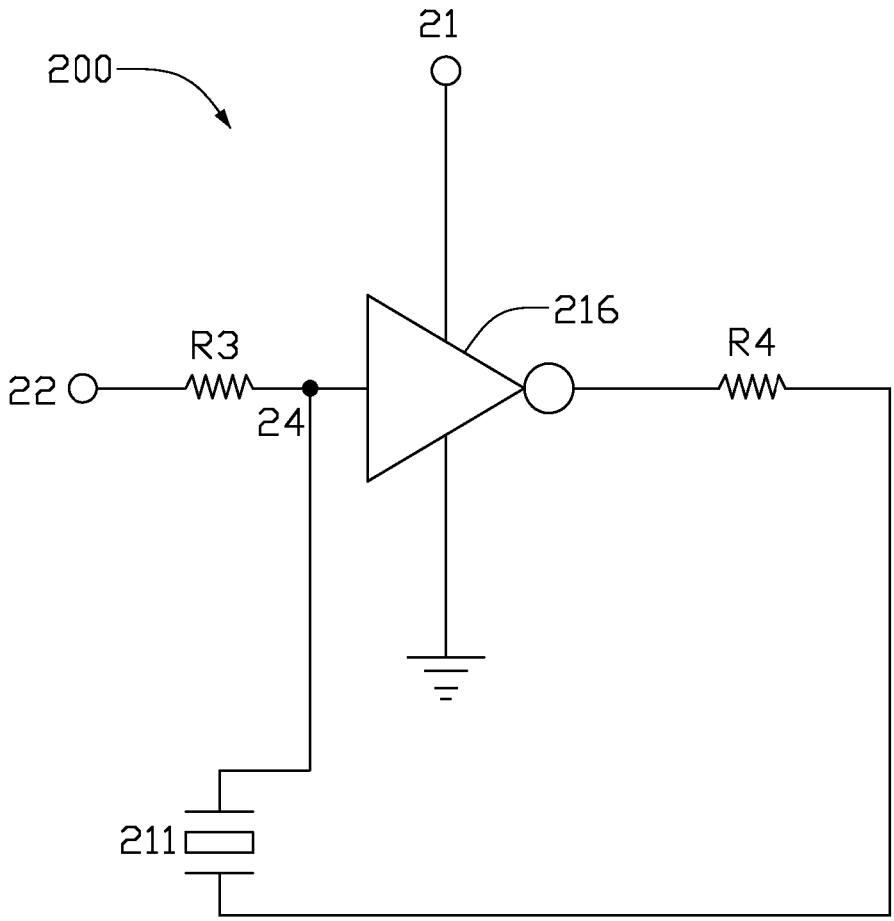
FIG. 1 is a schematic view of a buzzer driving circuit according to a first present embodiment.

Corresponding reference characters indicate corresponding parts throughout the drawings. The exemplifications set out herein illustrate at least one present embodiment of the present piezoelectric buzzer driving circuit, in one form, and such exemplifications are not to be construed as limiting the scope of the invention in any manner.

DETAILED DESCRIPTION OF THE INVENTION

Reference will now be made to the drawings to describe present embodiments of the piezoelectric buzzer driving circuit.

Figure 2:
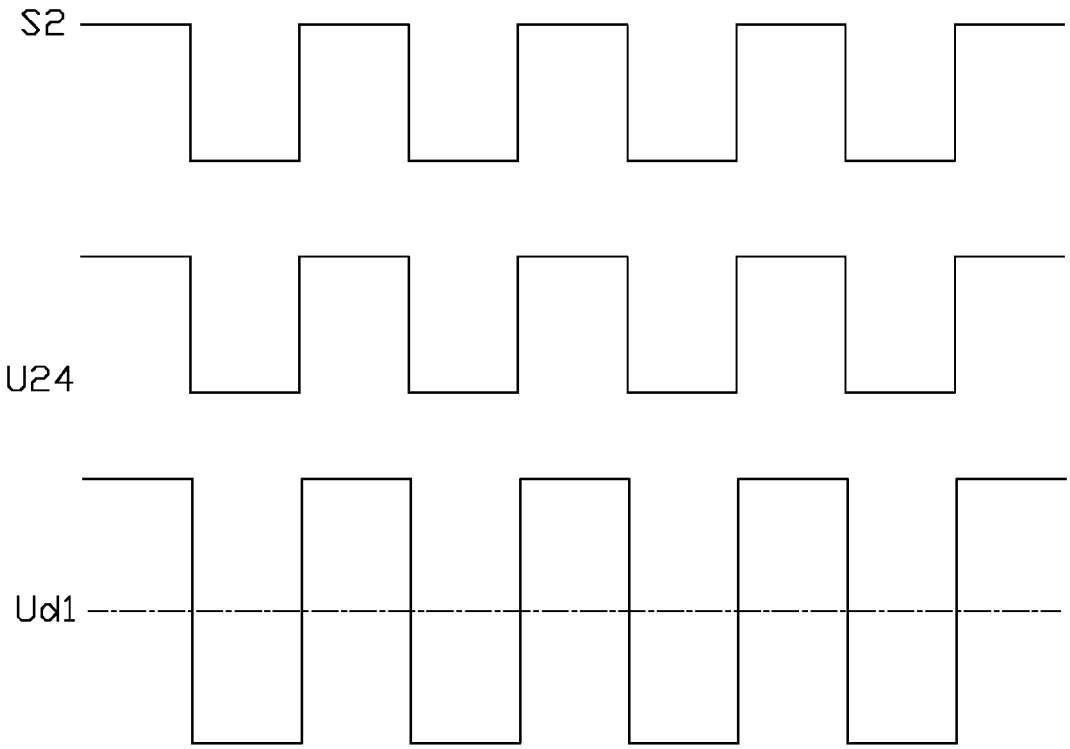
FIG. 2 is a voltage waveform view of respective points shown in FIG. 1.

Referring to FIGS. 1 and 2, a piezoelectric buzzer driving circuit 200 for driving a piezoelectric buzzer 211 according to a first present embodiment is shown. The piezoelectric buzzer driving circuit 200 includes a reverser 216, a first resistor R3, and a second resistor R4. The first resistor R3 and the second resistor R4 are current-limiting resistors. The piezoelectric buzzer 211 includes a first terminal and a second terminal.

The reverser 216 includes an input terminal 24, an output terminal and a power supply terminal. The input terminal of the reverser 216 is connected to a controlling terminal 22 via the resistor R3. The output terminal of the reverser 216 is connected to the second terminal of the piezoelectric buzzer 211 via the resistor R4. The first terminal of the piezoelectric buzzer 211 is connected to the input terminal 24 of the reverser 26.

The power supply terminal of the reverser 216 provides a direct-current power supply with a voltage U21. The controlling terminal 22 provides a periodic impulse signal S2 with a constant frequency. In this present embodiment, a waveform of the periodic impulse signal S2 is a rectangular waveform, as shown in FIG. 2.

When the periodic impulse signal S2 is high, a voltage U24 of the input terminal 24 of the reverser 216 is the same as that of the periodic impulse signal S2. Therefore, a waveform of the voltage U24 is the same as that of the periodic impulse signal S2, as shown in FIG. 2. That is, voltage at the first terminal of the piezoelectric buzzer 211 is also high when the periodic impulse signal S2 is high. Voltage at the output terminal of the reverser 216 is relatively low. Voltage at the second terminal of the piezoelectric buzzer 211 is also relatively low. Therefore, a voltage $U211_H$ across the piezoelectric buzzer 211 is high and is expressed as: $U211_H=U24$.

When the periodic impulse signal S2 is low, the input terminal 24 of the reverser 216 is the same as that of the periodic impulse signal S2. That is, the voltage at the first terminal of the piezoelectric buzzer 211 is also low. The voltage at the output terminal of the reverser 216 is relatively high. The voltage at the second terminal of the piezoelectric buzzer 211 is also high. Therefore, a voltage $U211_L$ across the buzzer 211 is low and is expressed as: $U211_L=-U24$.

During a period of the periodic impulse signal S2, a D-value (difference between two values) Ud1 of the voltage across the piezoelectric buzzer 211 is expressed as: $Ud1=U211_H-U211_L=U24-(-U24)=2\times U24$. A waveform of the D-value Ud1 is also shown in FIG. 2.

It is understood that the reverser 216 is selected from the group consisting of transistor, TTL (transistor-transistor logic), and CMOS (complementary metal oxide semiconductor). If the reverser 216 is a transistor, the base of the transistor is connected to the controlling terminal 22 via a gate resistor and a current-limiting resistor in series, the collector is connected to the direct-current power supply terminal via a resistor, and the emitter is grounded.

Since the piezoelectric buzzer driving circuit 200 includes the reverser 216, the D-value of the voltage across the piezoelectric buzzer 211 is twice as large as the input voltage at the reverser 216, even if the input voltage is a voltage used in a typical buzzer driving circuit. Therefore, the sound efficiency of piezoelectric buzzer 211 is satisfactory even with a low input voltage.

Figure 3:
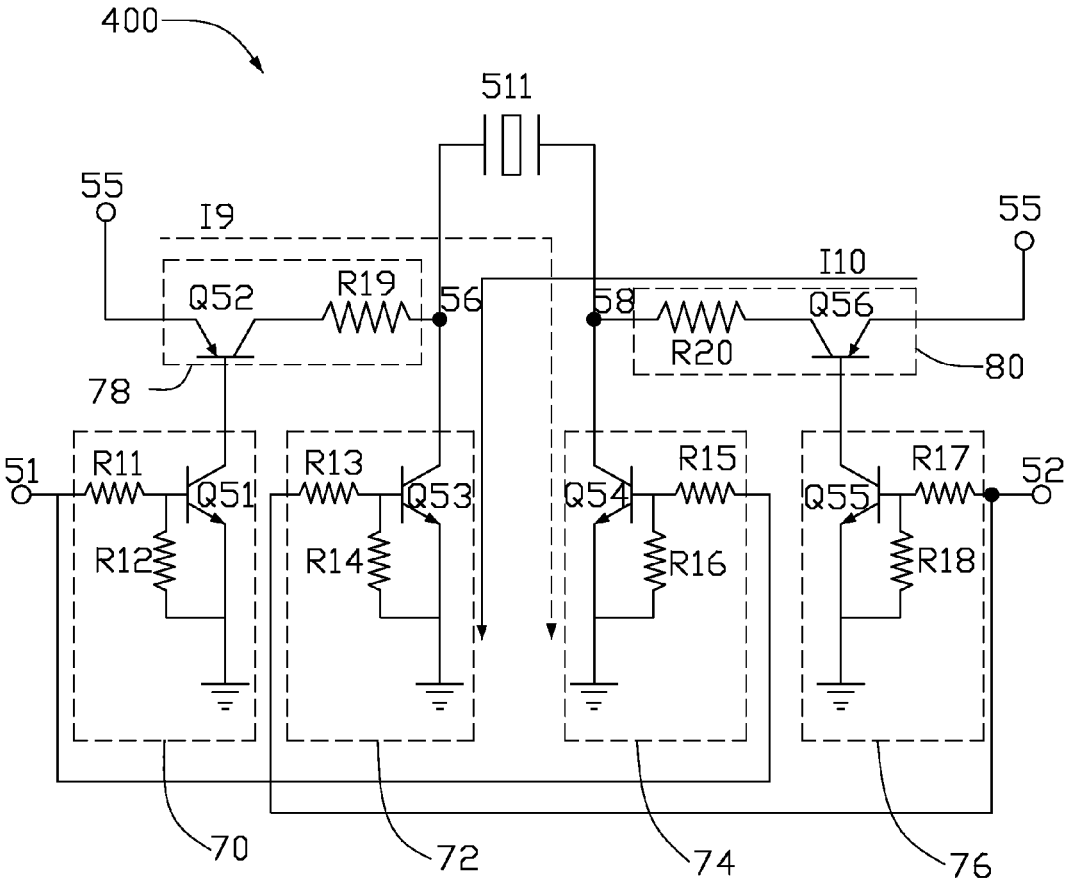
FIG. 3 is a schematic view of a buzzer driving circuit according to a second present embodiment.

Referring to FIG. 3, a piezoelectric buzzer driving circuit 400 according to a second present embodiment for piezoelectric buzzer 511 is shown. The piezoelectric buzzer driving circuit 400 includes a first switching circuit 70, a second switching circuit 72, a third switching circuit 74, a fourth switching circuit 76, a fifth switching circuit 78, and a sixth switching circuit 80.

The first switching circuit 70 includes a transistor Q51, and two resistors R11 and R12. The second switching circuit 72 includes a transistor Q53, and two resistors R13 and R14. The third switching circuit 74 includes a transistor Q54, and two resistors R15 and R16. The fourth switching circuit 76 includes a transistor Q55, and two resistors R17 and R18. The fifth switching circuit 78 includes a transistor Q52 and a resistor R19. The sixth switching circuit 80 includes a transistor Q56 and a resistor R20.

The base of the transistor Q51 is connected to a first controlling terminal 51 configured for providing a first controlling signal S3 to the piezoelectric buzzer 511 via the resistor R11. The emitter of the transistor Q51 is grounded. The collector of the transistor Q51 is connected to the base of the transistor Q52. Two terminals of the resistor R12 are respectively connected to the base and the emitter of the transistor Q51.

The base of the transistor Q53 is connected to a second controlling terminal 52 configured for providing a second controlling signal S4 to the piezoelectric buzzer 511 via the resistor R13. The emitter of the transistor Q53 is grounded. The collector of the transistor Q53 is connected to the collector of the transistor Q52 via the resistor R19. Two terminals of the resistor R14 are respectively connected to the base and the emitter of the transistor Q53.

The base of the transistor Q54 receives the first controlling signal S3 via the resistor R15. The emitter of the transistor Q54 is grounded. The collector of the transistor Q54 is connected to the collector of the transistor Q56 via the resistor R20. Two terminals of the resistor R16 are respectively connected to the base and the emitter of the transistor Q54.

The base of the transistor Q55 receives the second controlling signal S4 via the resistor R17. The emitter of the transistor Q55 is grounded. The collector of the transistor Q55 is connected to the base of the transistor Q56. Two terminals of the resistor R18 are respectively connected to the base and the emitter of the transistor Q55.

The emitter of the transistor Q52 and the emitter of the transistor Q56 both are connected to a power supply terminal 55.

The first terminal of the piezoelectric buzzer 511 is connected to the collector of the transistor Q53. The second terminal of the piezoelectric buzzer 511 is connected to the collector of the transistor Q54.

Figure 4:
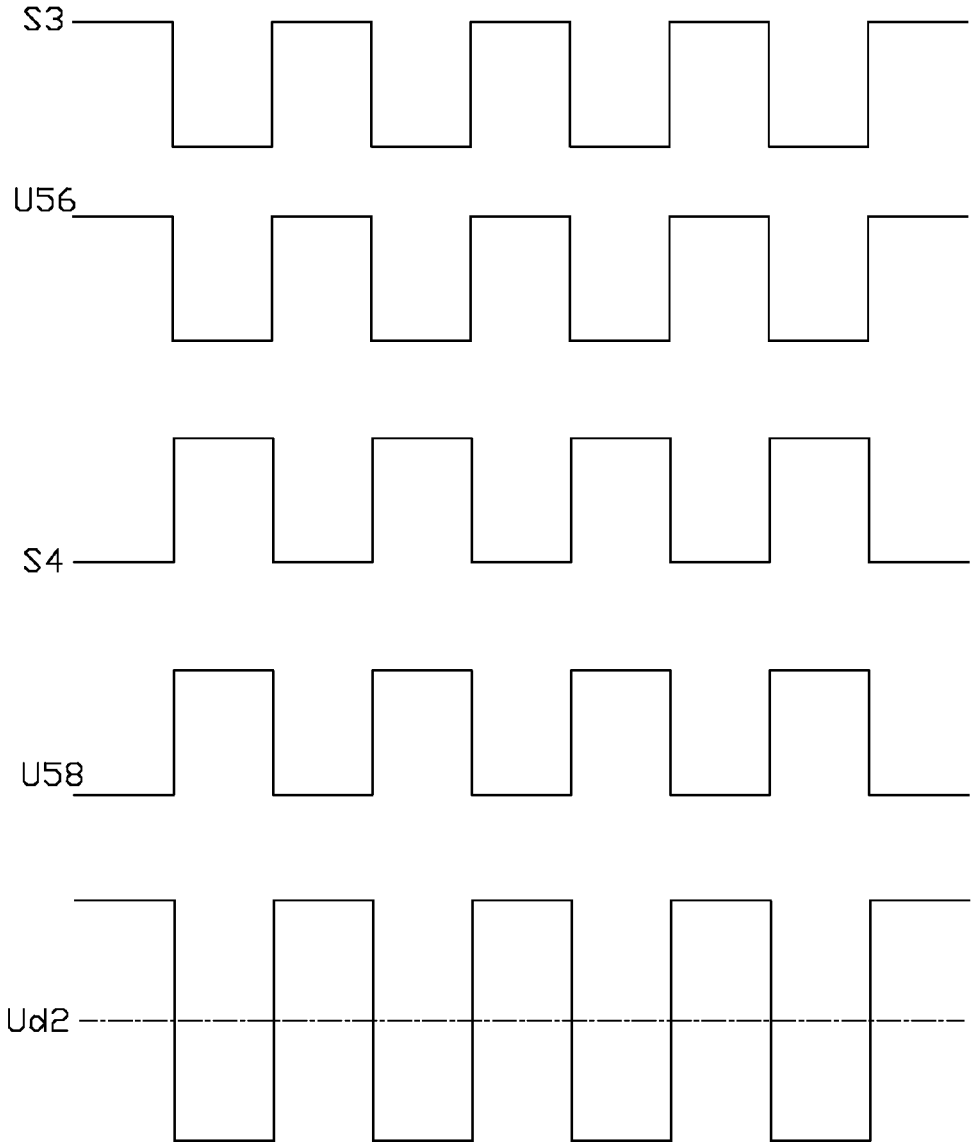
FIG. 4 is a voltage waveform view of respective points shown in FIG. 3.
Figure 5:
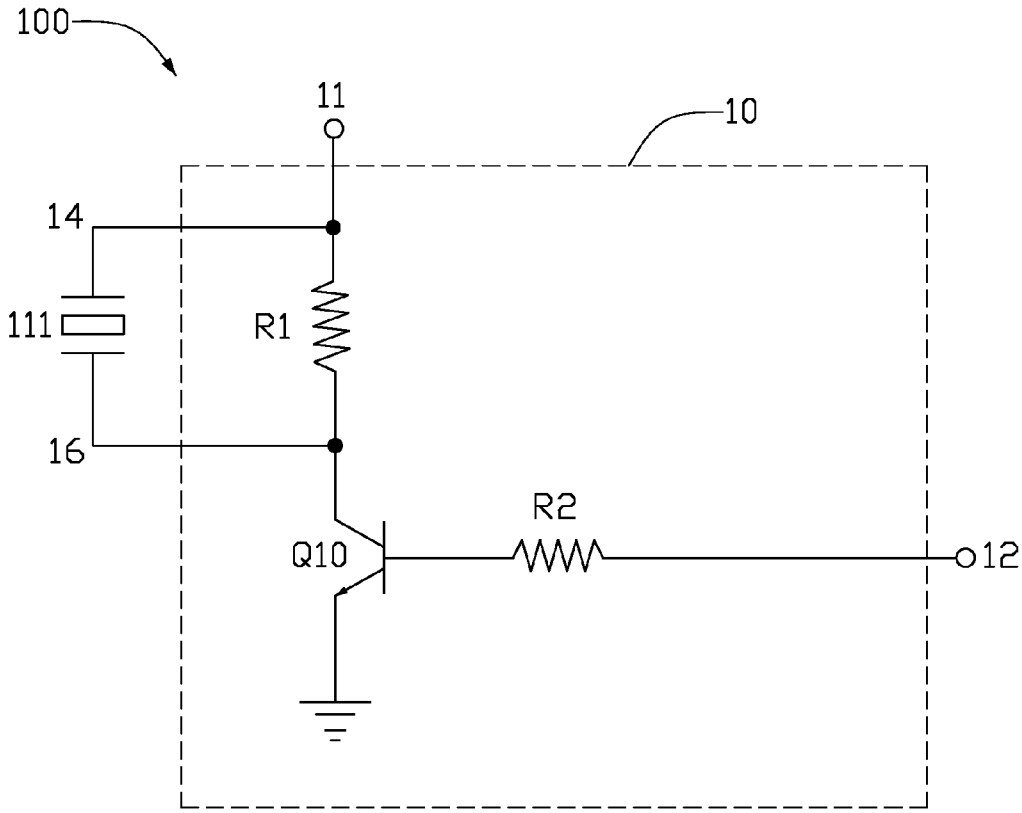
FIG. 5 (RELATED ART)
FIG. 5 is a schematic view of a typical buzzer driving circuit.

In this present embodiment, a waveform of each of the controlling signals S3, S4 is rectangular as shown in FIG. 4. A frequency of the first controlling signal S3 is the same as that of the second controlling signal S4, but signals S3 and S4 are 180 degrees out of phase. The first controlling signal S3 is an impulse controlling signal with a voltage of U51, and the second controlling signal S4 is an impulse controlling signal with a voltage of U52. The power supply terminal 55 provides a direct-current power supply with a voltage of U55.

The first controlling signal S3 and the second controlling signal S4 control an output of the power supply terminal 55. The respective voltages of the first controlling signal S3 and the second controlling signal S4 vary between high and low during each period.

The resistor R19 and R20 in the piezoelectric buzzer driving circuit are current-limiting resistors. The collector of the transistor Q53 is set as a first voltage-controlling terminal 56 with a voltage U56 of the piezoelectric buzzer driving circuit 400. The collector of the transistor Q54 is set as a second voltage-controlling terminal 58 with a voltage U58 of the piezoelectric buzzer driving circuit 400. Two terminals of the piezoelectric buzzer 511 are respectively connected to the first voltage-controlling terminal 56 and the second voltage-controlling terminal 58. Therefore, a voltage U511 across the piezoelectric buzzer 511 is expressed as: U511=U56−U58.

When the first controlling signal S3 is high while the second controlling signal S4 is low, the transistors Q51, Q54, and Q52 are turned on, and the transistors Q53, Q55, and Q56 are turned off, and direction of current through the piezoelectric buzzer driving circuit 400 is indicated by a dashed line 19 in FIG. 3. Therefore, the voltage U56 of the first voltage-controlling terminal 56 is equal to the voltage U55 of the power supply terminal 55. The second voltage-controlling terminal 58 is grounded. The voltage U58 of the second voltage-controlling terminal 58 is equal to zero. That is to say, the voltage U56 of the first voltage-controlling terminal 56 is high while the voltage U58 of the second voltage-controlling terminal 58 is low. Waveforms of the voltages U56, U58 are shown in FIG. 4. The voltage U511 across the piezoelectric buzzer 511 is expressed as: U511=U56−U58=U55−0=U55.

When the first controlling signal S3 is low and the second controlling signal S4 is high, the transistors Q53, Q55, and Q56 are turned on, and the transistors Q51, Q54, and Q52 are turned off, and direction of current through the piezoelectric buzzer driving circuit 400 is indicated by a solid line 110 as shown in FIG. 3. Therefore, the first voltage-controlling terminal 56 is grounded. The voltage U56 at the first voltage-controlling terminal 56 is equal to zero. The voltage U58 at the second voltage-controlling terminal 58 is equal to the voltage U55 at the power supply terminal. That is to say, the voltage U58 of the first voltage-controlling terminal 58 is high. The voltage U511 across the piezoelectric buzzer 511 is expressed as: U511=U56−U58=0−U55−=−U55.

With the above description, during each period of the controlling signals S3 and S4, a D-value Ud2 of the voltage at the piezoelectric buzzer 211 is expressed as: Ud2=U55−(−U55)=2×U55. A waveform of the D-value Ud2 is also shown in FIG. 4.

The piezoelectric buzzer driving circuit of this present embodiment has the same advantages as that of the first present embodiment.

It is to be understood that the above-described embodiment is intended to illustrate rather than limit the invention. Variations may be made to the embodiment without departing from the spirit of the invention as claimed. The above-described embodiments are intended to illustrate the scope of the invention and not restrict the scope of the invention.

What is claimed is:

1. A piezoelectric buzzer driving circuit for driving a piezoelectric buzzer with two terminals, the piezoelectric buzzer driving circuit comprising:

a reverser including an output terminal and an input terminal configured for receiving a controlling signal to control an output of the reverser, the two terminals of the piezoelectric buzzer respectively connected to the input terminal and the output terminal such that a D-value of the voltage across the piezoelectric buzzer is twice as large as the voltage of the controlling signal.

2. The piezoelectric buzzer driving circuit as claimed in claim 1, wherein the controlling signal is a periodic voltage impulse signal input to one of the terminals of the piezoelectric buzzer coupled to the input terminal of the reverser, and the reverser reverses the periodic voltage impulse signal and outputs the reversed periodic voltage impulse signal to the other terminal of the piezoelectric buzzer.

3. The piezoelectric buzzer driving circuit as claimed in claim 2, further comprising a first resistor and a second resistor, wherein the first resistor is connected to the input terminal of the reverser and said one of the terminals of the piezoelectric buzzer to cause the controlling signal passing therethrough before transmitted to the input terminal of the reverser and said one of the terminals of the piezoelectric buzzer, and the second resistor is connected between the output terminal of the reverser and the other one terminal of the piezoelectric buzzer.

4. The piezoelectric buzzer driving circuit as claimed in claim 3, wherein the reverser is selected from the group consisting of transistor, TTL (transistor-transistor logic), and CMOS (complementary metal oxide semiconductor).

5. A piezoelectric buzzer driving circuit for driving a piezoelectric buzzer with two terminals, the driving circuit comprising:

a first switching circuit, a second switching circuit, a third switching circuit, a fourth switching circuit, a fifth switching circuit including a first voltage-controlling terminal, a sixth switching circuit including a second voltage-controlling terminal, wherein:

the two terminals of the piezoelectric buzzer are respectively connected to the first voltage-controlling terminal and the second voltage-controlling terminal, with the fifth switching circuit and the sixth switching circuit both being connected to a power supply;

one terminal of the second switching circuit is connected to the first voltage-controlling terminal, another terminal of the second switching circuit is grounded, and one terminal of the third switching circuit is connected to the second voltage-controlling terminal, with another terminal of the third switching circuit being grounded;

the first switching circuit and the fourth switching circuit are respectively configured for turning the fifth switching circuit and the sixth switching circuit on or off;

the first switching circuit and the third switching circuit are configured for receiving a first controlling signal, and the second switching circuit and the fourth switching circuit are configured for receiving a second controlling signal;

when the first controlling signal turns the first switching circuit and the third switching circuit on, the fifth switching circuit turns on, when the second controlling signal turns the second switching circuit and the fourth switching circuit off, the sixth switching circuit is turned off, the power supply inputs a voltage to the piezoelectric buzzer driving circuit via the first voltage-controlling terminal, and the second voltage-controlling terminal is grounded due to the third switching circuit being in an 'on' position;

when the first controlling signal turns the first switching circuit and the third switch circuit off, the fifth switching circuit is turned off, if the second controlling signal turns the second switching circuit and the four the switching circuit on, the sixth switching circuit is turned on, the power supply inputs a voltage to the piezoelectric buzzer driving circuit via the second voltage-controlling terminal, and the first voltage-controlling terminal is grounded due to the second switching circuit being in an 'on' position.

6. The piezoelectric buzzer driving circuit as claimed in claim 5, wherein the first controlling signal and the second controlling signal are periodic impulse signals with identical frequency, and the first controlling signal and the second controlling signal are 180 degrees out of phase.

7. The piezoelectric buzzer driving circuit as claimed in claim 6, wherein the fifth switching circuit and the sixth switching circuit both include a respective switch-in terminal, the first switching circuit, the second switching circuit, the third switching circuit, and the fourth switching circuit all include a respective transistor having a base, an emitter, and a collector, a respective first resistor, a respective second resistor, wherein:

the base of the transistor of the first switching circuit and the base of the transistor of the third switching circuit are both connected to the first controlling signal via the first resistor;

the collector of the transistor of the first switching circuit is connected to the switch-in terminal of the fifth switching circuit, the collector of the transistor of the fourth switching circuit is connected to the switch-in terminal of the sixth switching circuit;

the base of the transistor of the second switching circuit and the base of the transistor of the fourth switching circuit are both configured for receiving the second controlling signal via the first resistor;

the collector of the transistor of the second switching circuit is connected to the first voltage-controlling terminal, and the collector of the transistor of the third switching circuit is connected to the second voltage-controlling terminal;

two terminals of the second resistor are respectively connected to the base and the emitter of the transistor of each switching circuit, and the emitter of the transistor of each switching circuit is grounded.

8. The piezoelectric buzzer driving circuit as claimed in claim 5, wherein the power supply is a direct-current power supply.

9. A driving circuit configured for driving a piezoelectric buzzer with two terminals, comprising:

a first voltage-controlling terminal connected to one of the terminals of the piezoelectric buzzer;

a second voltage-controlling terminal connected to the other one of the terminals of the piezoelectric buzzer;

a first switching circuit connected between a power supply terminal and the first voltage-controlling terminal;

a second switching circuit connected between another power supply terminal and the second voltage-controlling terminal;

a third switching circuit coupled to the first switching circuit and configured to receive a first controlling signal and control the first switching circuit on or off based on the first controlling signal;

a fourth switching circuit coupled to the second switching circuit and configured to receive a second controlling signal and control the second switching circuit on or off based on the second controlling signal, wherein a frequency of the first controlling signal is the same as that of the second controlling signal but the first controlling signal and the second controlling signal are 180 degrees out of phase such that a D-value of the voltage across the piezoelectric buzzer is equal to the voltage value at the power supply terminal plus the voltage value at the another power supply terminal.

10. The piezoelectric buzzer driving circuit as claimed in claim 9, further comprising a fifth switching circuit connected between the first voltage-controlling terminal and ground, and a sixth switching circuit connected between the second voltage-controlling terminal and ground, wherein the fifth switching circuit comprises a control terminal configured to receive the first controlling signal and the sixth switching circuit comprises a control terminal configured to receive the second controlling signal.

* * * * *